US005831535A

United States Patent [19]

Reisman et al.

[11] Patent Number: 5,831,535

[45] Date of Patent: Nov. 3, 1998

[54] ELECTRONIC MONITORING DEVICE AND MONITORING SYSTEM INCLUDING SAME

[75] Inventors: Yoav Reisman, Ra$^3$anana; Guy Greitser, Haifa; Gil Gemer, Nirit; Tzahi Itzhak Pilli, Tel Aviv, all of Israel

[73] Assignee: Elmo-Tech Ltd., Herzliya, Israel

[21] Appl. No.: 899,611

[22] Filed: Jul. 24, 1997

[51] Int. Cl.$^6$ ..... G08B 13/06

[52] U.S. Cl. ..... 340/573; 340/568; 340/572; 340/687; 379/38

[58] Field of Search ..... 340/572, 573, 340/540, 539, 533, 568, 687; 379/38

[56] References Cited

U.S. PATENT DOCUMENTS

| | | | |
|---|---|---|---|
| 4,694,284 | 9/1987 | Leveille | 340/574 |
| 4,736,196 | 4/1988 | McMahon et al. | 340/573 |
| 4,812,823 | 3/1989 | Dickerson | 340/572 |
| 4,885,571 | 12/1989 | Pauley | 340/573 |
| 4,918,432 | 4/1990 | Pauley et al. | 340/573 |
| 4,924,211 | 5/1990 | Davies | 340/573 |
| 4,952,913 | 8/1990 | Pauley et al. | 340/573 |
| 4,999,613 | 3/1991 | Williamson | 340/573 |
| 5,075,670 | 12/1991 | Bower | 340/573 |
| 5,103,474 | 4/1992 | Stoodley et al. | 455/403 |
| 5,504,474 | 4/1996 | Libman et al. | 340/572 |

*Primary Examiner*—Glen Swann
*Attorney, Agent, or Firm*—Foley & Lardner

[57] ABSTRACT

An electronic monitoring device to be attached to a subject for monitoring, at a remote location, movement and/or other activities of the subject, includes a closure member incorporating an identification tag having a unique identification number stored therein. The monitoring device further includes an electronic data processor programmed to read and store the identification number of the electronic tag when the closure member is applied, and periodically thereafter, to make a determination of whether a closure member is currently attached to the subject having an identification number matching the stored identification number, and to transmit to the remote location an identification signal corresponding to such determination.

20 Claims, 3 Drawing Sheets

ELECTRONIC MONITORING DEVICE AND MONITORING SYSTEM INCLUDING SAME

FIELD AND BACKGROUND OF THE INVENTION

The present invention relates to electronic monitoring devices, and particularly to such devices to be attached to a person for monitoring the movements or other activities of the person. The invention also relates to an electronic monitoring system including such devices.

As pointed out in U.S. Pat. No. 5,504,474, incorporated herein by reference and assigned to the same assignee as the present application, the increasing overcrowding of jails and houses of detention has increased the popularity to sentence certain types of offenders, particularly non-violent ones, to confinement within a pre-designated location, such as the offender's place of residence, the residence of a responsible relative, or the location of certain rehabilitating institutions. For this purpose, a number of electronic monitoring devices have been developed to be attached to a person for monitoring the movements or other activities of the person. Such electronic monitoring devices typically include sensors for sensing tampering with the device or removal of the device from the person to whom the device was attached, and for producing a corresponding tamper signal which is processed by a data processor and which is fed, with an identification signal identifying the respective device, to a transmitter for transmission to an external receiver. The external receiver may be a stationary one or a mobile one. Frequently, the receiver is a local one located in the immediate area of the confinement and transmits its information to a central station which monitors the activities of many persons having electronic monitoring devices attached to them.

The above-cited U.S. Pat. No. 5,504,474 cites a large number of prior patents, which are also hereby incorporated by reference, relating to electronic monitoring devices and electronic monitoring systems of the foregoing type.

It will be seen that the effectiveness of such an electronic monitoring device depends to a great extent on the assurance that the device has not been removed from the subject or tampered with. The above-cited U.S. Pat. No. 5,504,474, and the large number of patents cited therein, disclose various types of arrangements for providing this assurance. Generally, the known arrangements include sensors which sense whether the device is against the subject's skin as it should be, whether the strap attaching the device to the subject's wrist or ankle has been cut, and/or whether the closure member, which secures the strap ends to the subject's wrist or ankle, has been broken.

The foregoing sensors are tested periodically at relatively short sampling periods, e.g., three seconds, to assure quick detection of any attempt to tamper with the monitoring device. However, particularly where longer sampling periods are used, e.g. to save power, it may be possible for a subject to quickly remove the monitoring device from the subject's body, and reattach it to another body, e.g., a baby, by the use of another closure member (e.g., a stolen one), thereby leaving the subject free to commit offences without detection.

Also, it is possible that when the subject is outside a monitoring range during a non-monitored time period (which may be permitted), the subject could remove the monitoring device and, using another closure member, reattach the monitoring device to himself, or to another, before re-entering a monitored area, and thereby escape detection should the subject commit an offence.

OBJECT AND BRIEF SUMMARY OF THE INVENTION

An object of the present invention is to provide an electronic monitoring device having protection against the possibility that such a tampering or removal of the device will go undetected.

According to a broad aspect of the present invention, there is provided an electronic monitoring device to be attached to a subject for monitoring, at a remote location, movements and/or other activities of the subject, comprising: a housing attachable to the subject, and a closure member to secure the housing to the subject; the housing including electronic circuitry for receiving, processing, and transmitting to the remote location, data regarding the activities of the subject; the closure member including an identification tag having a unique identification number stored therein; the electronic circuitry including a data processor programmed to read and store the identification number from the tag when the closure member is applied to secure the housing to the subject, and periodically thereafter, to read the identification number of the closure member in the monitoring device attached to the subject, and to make a determination of whether a change has occured between the read identification number and the stored identification number, and to transmit to the remote location an identification signal corresponding to such determination.

Electronic identification tags having a unique identification number coded therein are known guaranteeing that no two identification tags will be alike. Incorporating such an electronic identification tag in the closure member provides assurance that if one closure member is broken, any attempt to replace it by another closure member will be detected since the two closure members would be identified by different identification numbers in their respective electronic identification tags.

According to further features in the described preferred embodiment, the housing is attachable to the subject by straps to enclose a limb of the subject and having ends securable together by the closure member according to the size of the limb. The closure member includes parts to be disposed on the opposite sides of the strap ends to be secured together, and the identification tag is a solid state electrical device located between the parts of the closure member so secured together.

According to still further preferred features, the identification tag is carried by the inner face of one of the parts of the closure member. In addition, the identification tag includes electrical connector elements brought into electrical communication (e.g. via direct contact, induction, etc.) with electrical connector elements on one of the strap ends when the closure member secures the strap ends together. At least one part of the closure member also has connector elements which are brought into electrical communication with the connector elements on one of the strap ends when the closure member secures the strap ends together.

According to still further features in the described preferred embodiment, the data processor is programmed to make determinations of whether the identification number has been changed, during relatively short sampling periods, e.g., of a few seconds; to store the results of the determination; and to transmit the results at the end of transmission periods. More particularly, in the described preferred embodiment, the sampling periods are each 5-seconds, and transmission periods are: (a) in the order of seconds (e.g., 20-seconds) if the determination is positive, that there was a change in the identification number; (b) in the order of minutes (e.g., 5-minutes) if the determination is negative, namely that there was no change in the identification number from the last sample, and a predetermined time period (e.g., a week) has not elapsed since the time the identification number was stored; and (c) in the order of an hour if the determination is negative, namely that there was no change in the identification number, and the latter predetermined time period (e.g., a week) has elapsed since the time the identification number was stored.

It will be appreciated that the forgoing transmission periods apply only to the transmission of the identification information, and that the other transmissions, e.g. tampering, body proximity, etc., continue at their normal intervals, e.g., 20-second intervals.

It has been found that such an arrangement provides the required notice to the remote location with the immediacy needed for the particular situation, but with a minimum drain of power from the battery supplying the monitoring device, thereby extending the useful life of the battery before recharging or replacing.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
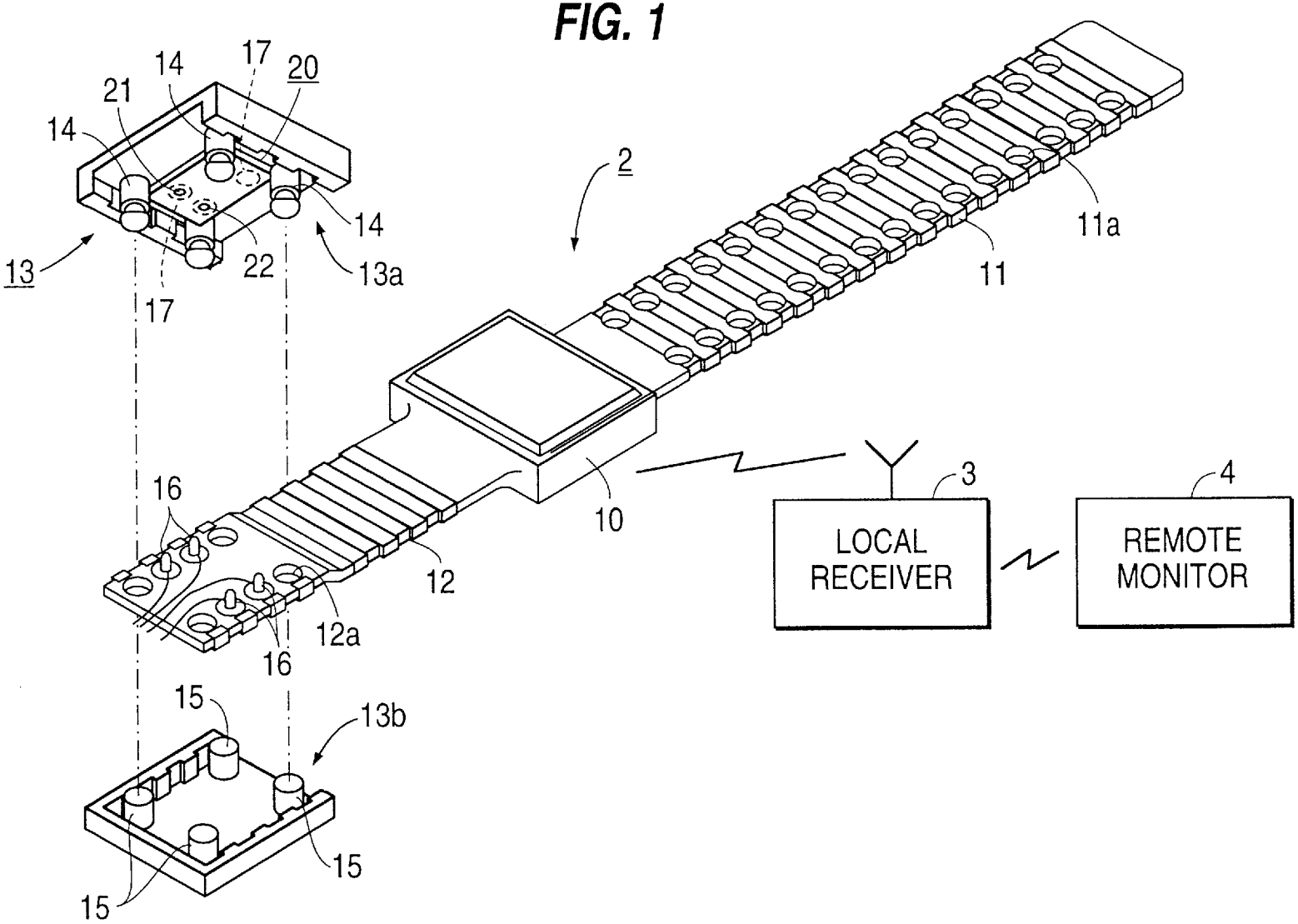
FIG. 1 illustrates one form of electronic monitoring device constructed in accordance with the present invention and the monitoring system with which the device is used.

FIG. 1 illustrates an electronic monitoring device, generally designated 2, to be attached to a person for monitoring movements and other activities of the person. These activities as detected by monitoring device 2 are transmitted to a local receiver 3 located in the general area of the person being monitored, such as the person's home residence. The information received by the local receiver 3 is in turn transmitted to a remote monitor 4 which monitors the activities of a number of persons each equipped with a personal monitoring device 2. The transmission from the monitoring device 2 to the local receiver 3 is by wireless transmission; the transmission from local receiver 3 to the remote monitor 4 may be by wireless transmission or by wires, e.g., via the regular telephone or a cellular telephone.

Electronic monitoring device 2 includes a housing 10 for housing the electronic circuitry, and a pair of straps 11, 12 defining a band for attaching the housing to a limb, preferably the ankle or wrist of the person to be monitored. To enable the monitoring device to be used with different size persons, both straps 11 and 12 are provided with a plurality of pairs of holes 11*a*, 12*a* along their lengths, cooperable with a closure member 13 for fixing the effective lengths of the two straps according to the size of the person's ankle or wrist. Closure member 13 includes two parts 13*a*, 13*b* to be disposed on the opposite sides of the overlapping ends of the two straps 11, 12 after the monitoring device has been applied to the person. Part 13a*a* includes four pins 14, and part 13*b* includes four complementary sockets 15, such that after the ends of the two straps 11, 12 have been applied around the person's ankle (or wrist), pins 14 of part 13*a* may be passed through the appropriate aligned holes 11*a*, 12*a*, of the overlapping ends of the two straps 11, 12, and force-fitted into their respective sockets 15 of part 13*b*, to fix the monitoring device to the person's ankle (or wrist).

The illustrated monitoring device 2 further includes a tamper sensor for sensing any tampering with the monitoring devices or its removal from the person to whom it was attached. The tamper sensor in the illustrated monitoring device may be the same as described in the above-cited U.S. Pat. No. 5,504,474. Such a sensor includes electrical conductors (not shown) extending through the two straps 11, 12, electrical terminals 16 provided in the end of strap 12, and electrical pads 17 formed in part 13*a* engageable by terminals 16 when the two parts 13*a*, 13*b* of the closure member 13 are fixed as required to the overlapping ends of the two straps. The arrangement is that any cutting of strap 11 or 12, or any attempt to separate the two parts 13*a*, 13*b* from the straps, will result in a break in the continuity of the electrical circuit which would be sensed by the electrical circuitry within housing 10.

Further details of the construction of the tamper sensor, the straps 11, 12, and of the two-part closure member 13, are set forth in the above-cited U.S. Pat. No. 5,504,474, whose contents are incorporated by reference.

According to the present invention, an electronic identification tag, generally designated 20 in FIG. 1, is provided between the two parts 13*a*, 13*b*, of the closure member 13, before the two parts are attached together with the ends of the straps 11, 12, in between. The electronic identification tag 20 may be inserted between the two parts 13*a*, 13*b* before they are attached together, but preferably is included in one of the parts, in this case on its inner face of part 13*a* before the two parts are attached together with the ends of the straps in between.

Electronic identification tag 20 is a solid-state semiconductor chip having a unique identification code therein. It includes electrical connector terminals, shown at 21 and 22, which are brought into electrical contact with the electrical connector elements 16, 17, on the strap end and closure member part 13*a*, respectively, enabling the unique identification code therein to be read by the electronic circuitry within housing 10.

A preferred electronic identification device that may be used is Silicon Serial No. DS2401 supplied by Dallas Semiconductor Corporation. This device is a factory-lasered, 64-bit ROM that includes a unique 48-bit serial number, an 8-bit CRC (Cyclic Redundancy Check), and an 8-bit family code (01 h); data is transferred serially via a 1-wire protocol which requires only a single data lead and a ground return.

Figure 2:
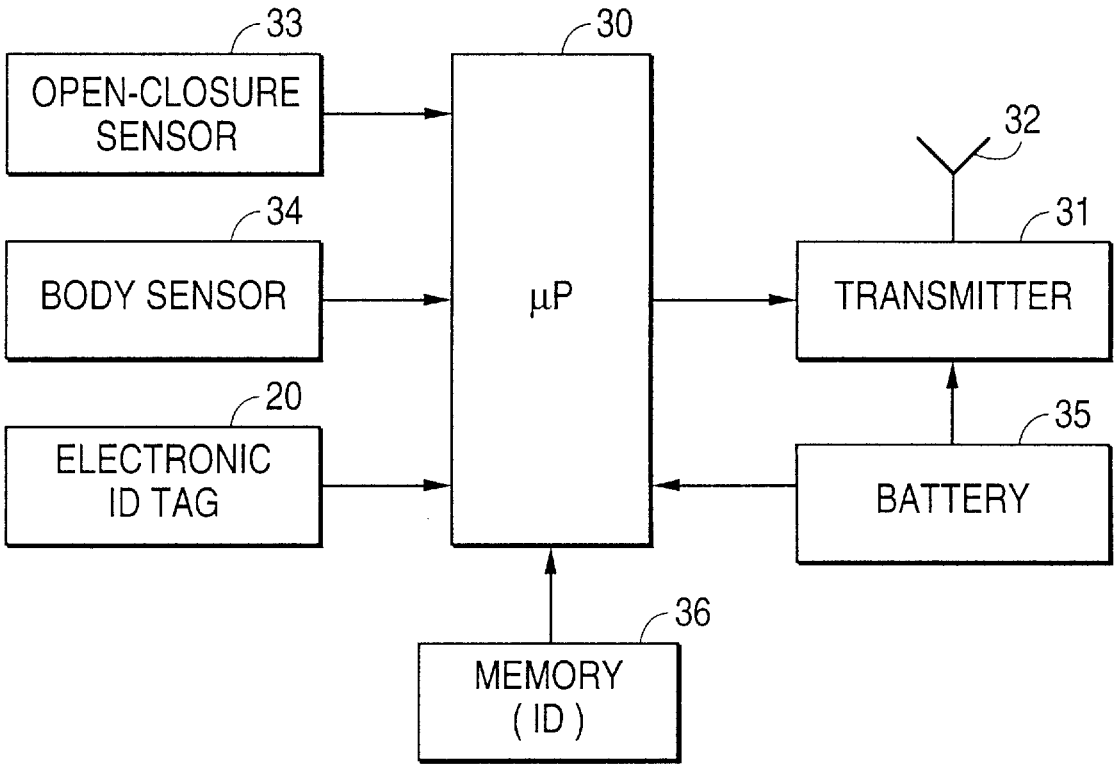
FIG. 2 is a block diagram of the electronic system used in the electronic monitoring device of FIG. 1.

The electronic circuitry within housing 10 includes an electronic data microprocessor 30 and a transmitter 31, as shown in FIG. 2, for receiving, processing and transmitting, via antenna 32, data regarding the movements and other activities of the subject to which the monitoring device 10 is attached. As shown in FIG. 1, this data is transmitted in a wireless manner first to the local receiver 3 located in the general area of the subject being monitored, and the local receiver in turn transmits this data, by wireless or wired transmission, to the remote monitor 4 serving as a central station for monitoring the activities of many subjects.

Thus, as shown in FIG. 2, the inputs to the microprocessor 30 includes an open-closure sensor 33 to detect the opening or breakage of closure member 13 (or the cutting of the straps 11, 12), and a body (proximity) sensor 34 to detect removal of the monitoring device from against the subject's skin, as described for example in the above-cited U.S. Pat. No. 5,504,474. FIG. 2 also illustrates the battery power supply 35 for powering the electronic circuitry.

FIG. 2 further illustrates the electronic identification tag 20 whose unique identification number stored therein is also inputted into the microprocessor 30. This identification number is read into the microprocessor when the closure member is applied to secure the ends of the straps 11, 12 to the subject, and is stored in its memory 36. Periodically thereafter, microprocessor 30 reads the identification number of the closure member attached to it, compares the so-read identification number with that stored in memory 36, makes a determination whether a change has occurred between the read identification number and the stored one, and transmits an identification signal corresponding to such determination.

Figure 3:
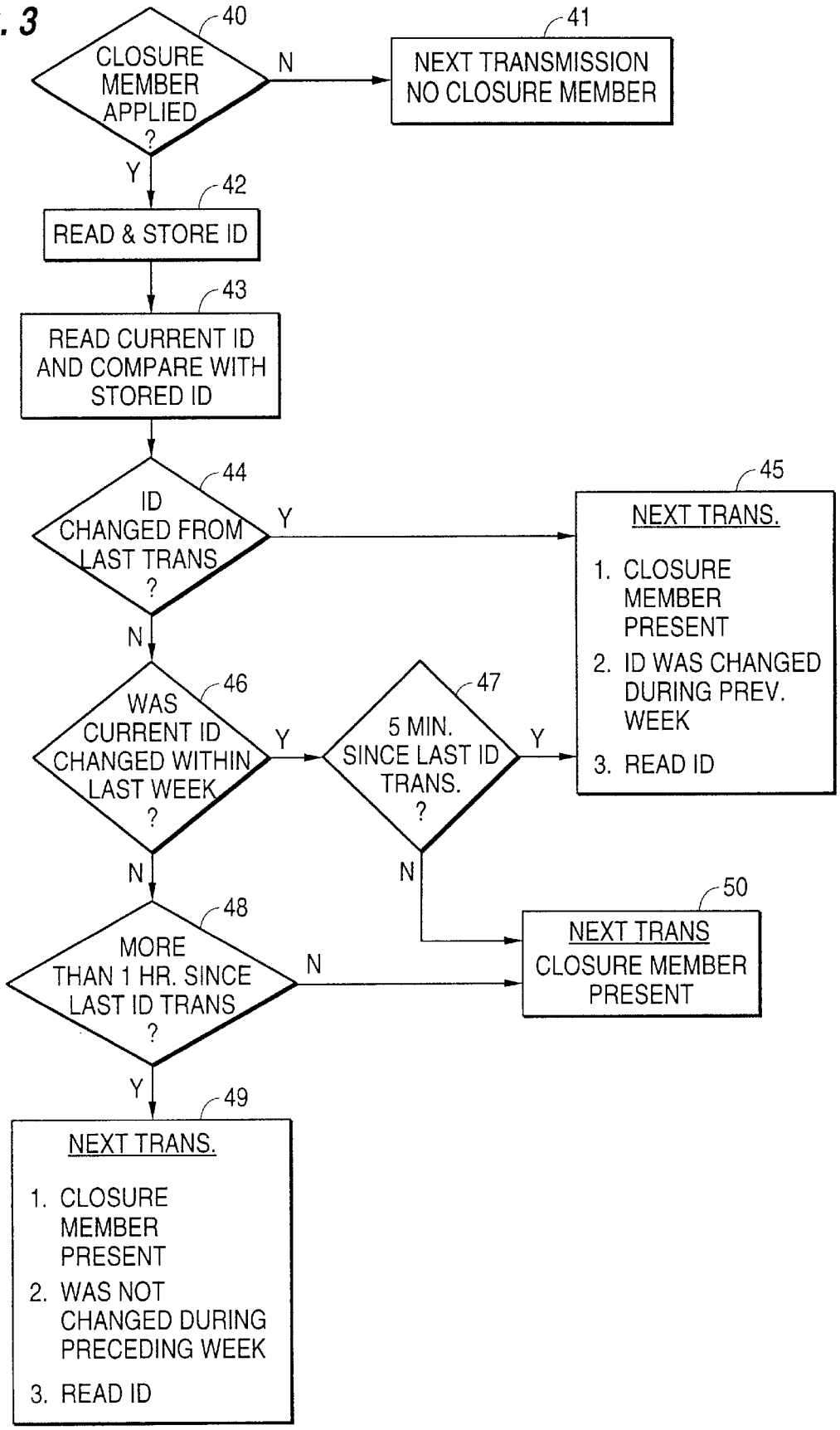
FIG. 3 is a flowchart illustrating a preferred operation of the microprocessor in the electronic monitoring device of FIGS. 1 and 2.

FIG. 3 illustrates a flowchart of a preferred algorithm for operating the microprocessor 30 in order to provide notice to the remote location of an attempt to remove the monitoring device from a subject, or a change in the identification number of the closure member used in the monitoring device, with reasonable immediacy and with a minimum drain on the battery power supply 35. For this purpose, the identification information transmitting period during the first week of use of the monitoring device is somewhat different from subsequent periods.

Thus, as shown in FIG. 3, a check is made, via open-closure sensor 33, whether the closure member is applied (block 40). Such checks could be made every 3-seconds, for example, stored, and transmitted at transmission intervals of 20-seconds. If a closure member is not detected, the next transmission (e.g., 20-seconds later) would indicate this (block 41). If a closure member is detected, the identification number stored in its electronic tag 20 is merely read by the microprocessor 30 and stored in its memory 36.

During every sampling period (e.g., 3-seconds) thereafter, the identification of the current closure member is read and compared with the stored identification number (block 43). A determination is made as to whether the current identification number was changed from the last transmission (block 44). If yes, the next 20-second transmission will include the facts (1) that a closure member was present, (2) that the closure member was changed during the preceding week, and (3) the identification of the current closure member (block 45).

However, if the check in block 44 is "no", then a check is made whether the identification number was changed during the last week. If "yes", the data of block 45 is sent once every 5 minutes (block 47).

Whenever it is determined that the current identification number was not changed within the last week (i.e., starting with the beginning of the second week and continuously thereafter until a new identification number is stored by applying the monitoring device to a different subject), the frequency of transmission of the identification information will be changed from 5 minutes to one hour (block 48), and the transmission will include the information of block 49.

When there was no change from the last transmission and there is no need to send identification information per blocks 47 and 48, the next transmission includes only the fact that a closure member was present (block 50).

As indicated above, such an arrangement has been found to provide immediate notice of any attempted change, but was a minimum drain of power from the battery to provide a relatively long useful life before recharging or replacing is required.

While the invention has been described with respect to one preferred embodiment, it will be appreciated that this is set forth merely for purposes of example, and that many variations and other applications of the invention may be made. For example, the identification number tag could be other than electronic, e.g., optical, and fed to the data processor optically, by induction, etc. In addition, the monitoring device may be used for monitoring movements other than those under house arrest, e.g., movements of medical patients, children in shopping centers, animals, etc. Further, the identification number tag could be concealed and/or applied to e.g., the strap itself; and the monitoring device could be applied to parts of a subject other than the limbs, e.g., around the neck or attached to subject's clothing. Many other variations, modifications and applications of the invention will be apparent.

What is claimed is:

1. An electronic monitoring device to be attached to a subject for monitoring, at a remote location, movements and/or other activities of the subject, comprising:

a housing attachable to the subject, and a closure member to secure the housing to the subject;

said housing including electronic circuitry for receiving, processing, and transmitting to said remote location, data regarding the activities of the subject;

said closure member including an identification tag having a unique identification number stored therein;

said electronic circuitry including a data processor programmed to read and store said identification number from the tag when the closure member is applied to secure the housing to the subject, and periodically thereafter, to read the identification number of the closure member in the monitoring device attached to the subject, and to make a determination of whether a change has occured between the read identification number and the stored identification number, and to transmit to said remote location an identification signal corresponding to such determination.

2. The electronic monitoring device according to claim 1, wherein said housing is attachable to the subject by straps to enclose a limb of the subject and having ends securable together by said closure member according to the size of the limb; and wherein said closure member includes parts to be disposed on the opposite sides of the strap ends to be secured together, said identification tag being a solid state electrical device located between said parts of the closure member secured together on opposite sides of the strap ends.

3. The electronic monitoring device according to claim 2, wherein said identification tag is carried by the inner face of one of said parts of the closure member.

4. The electronic monitoring device according to claim 2, wherein said identification tag includes electrical connector elements brought into electrical communication with electrical connector elements on one of the strap ends when the closure member secures the strap ends together.

5. The electronic monitoring device according to claim 4, wherein at least one part of the closure member also includes connector elements which are brought into electrical communication with the connector elements on one of the strap ends when the closure member secures the strap ends together.

6. The electronic monitoring device according to claim 5, wherein said connector elements on said one part of the closure member are electrically connected together by a conductive pathway to the electrical connector elements of the straps end, which conductive pathway is interrupted by the removal of the closure member, thereby enabling the electronic data processor to sense such removal.

7. The electronic monitoring device according to claim 1, wherein said device further includes an open-closure sensor which feeds an open-closure signal to the data processor indicating whether the closure member is open or closed.

8. The electronic monitoring device according to claim 1, wherein said device further includes a body sensor which feeds a body-sensor signal to the data processor indicating whether said housing is adjacent to the subject's skin.

9. The electronic monitoring device according to claim 1, wherein said data processor is programmed:

to make said determination during relatively short sampling periods of a few seconds;

to store the results of said determination;

and to transmit said results at the end of transmission periods of larger duration than said sampling periods.

10. The electronic monitoring device according to claim 9, wherein said transmission periods are:

(a) in the order of seconds, if the determination is positive, that there was a change in the identification number;

(b) in the order of minutes, if the determination is negative, namely that there was no change in the identification number and a predetermined time period has not elapsed since the time the identification number was stored; and (c) in the order of an hour, if the determination is negative, namely that there was no change in the identification number, and said latter predetermined time period has elapsed since the time the identification number was stored.

11. An electrical monitoring device to be attached to a subject for monitoring, at a remote location, movements and/or other activities of the subject, comprising:

a housing attachable to the subject by another member;

said housing including an electrical data processor and a transmitter for receiving, processing, and transmitting to said remote location, data regarding the activities of the subject;

said another member including an electronic identification tag having a unique identification number stored therein;

said data processor being programmed to read and store said identification number from the tag whenever said another member is applied to the device to attach same to the subject, and periodically thereafter to read the identification number of the another number in the monitoring device attached to the subject, and to make a determination of whether a change has occurred between the read identification number of the monitoring device attached to the subject, and the stored identification number, and to transmit an identification signal corresponding to such determination.

12. The electronic monitoring device according to claim 11, wherein said data processor is programmed:

to make said determination during relatively short sampling periods of a few seconds;

to store the results of said determination;

and to transmit said results at the end of transmission periods of larger duration than said sampling periods.

13. The electronic monitoring device according to claim 12, wherein said transmission periods are:

(a) in the order of seconds, if the determination is positive, that there was a change in the identification number;

(b) in the order of minutes, if the determination is negative, namely that there was no change in the identification number and a predetermined time period has not elapsed since the time the identification number was stored; and (c) in the order of an hour, if the determination is negative, namely that there was no change in the identification number, and said latter predetermined time period has elapsed since the time the identification number was stored.

14. The electronic monitoring device according to claim 11, wherein said another member is a closure member including parts to be secured together when attaching the device to the subject, and wherein said electronic identification tag is a solid-state electrical device located between said parts of the closure member when secured together.

15. The electronic monitoring device according to claim 14, wherein said identification tag is carried by the inner face of one of said parts of the closure member.

16. The electronic monitoring device according to claim 14, wherein said housing is secured to the subject by straps having ends secured together by the closure member when the device is attached to the subject, said electronic identification tag being secured between said securing member and the strap ends when the parts of the closure member are secured together and to the strap ends.

17. The electronic monitoring device according to claim 16, wherein said electronic identification tag includes electrical connector elements brought into electrical contact with electrical connector elements on one of the strap ends when secured thereto between the two parts of the closure member.

18. The electronic monitoring device according to claim 17, wherein at least one part of the closure member also includes connector elements which are brought into electrical contact with the connector elements on the electronic identification tag when securing the strap ends together.

19. The electronic monitoring device according to claim 18, wherein said connector elements on said one part of the closure member are electrically connected together by a conductive pathway which is interruptable by the removal of the closure member to thereby enable the electronic data processor to sense such removal.

20. The electronic monitoring device according to claim 11, wherein said device further includes an open-closure sensor which feeds an open-closure signal to the data processor indicating whether the closure member is open or closed.

* * * * *